US005423120A

United States Patent [19]

Kaneko

[11] Patent Number: 5,423,120

[45] Date of Patent: Jun. 13, 1995

[54] PROCESS FOR MAKING PRESS-IN CONNECTION TYPE CONTACT

[75] Inventor: Tetsuya Kaneko, Tokyo, Japan

[73] Assignee: Yamaichi Electronics Co., Ltd., Tokyo, Japan

[21] Appl. No.: 169,988

[22] Filed: Dec. 16, 1993

[30] Foreign Application Priority Data

Dec. 17, 1992 [JP] Japan ..... 4-355824

[51] Int. Cl.[6] ..... H01R 43/16

[52] U.S. Cl. ..... 29/874; 29/882; 29/884; 439/397; 439/405

[58] Field of Search ..... 29/874, 882, 884; 439/395, 396, 397, 404, 405, 408

[56] References Cited

U.S. PATENT DOCUMENTS 4,089,580 5/1978 Huffnagle et al. ..... 439/404
4,270,831 6/1981 Takahashi .
4,918,813 4/1990 Mori et al. ..... 29/874

FOREIGN PATENT DOCUMENTS 2160372 12/1985 United Kingdom ..... 439/395
2164808 3/1986 United Kingdom ..... 439/397

*Primary Examiner*—Mark Rosenbaum
*Assistant Examiner*—David P. Bryant
*Attorney, Agent, or Firm*—Wenderoth, Lind & Ponack

[57] ABSTRACT

A press-in connection type contact, comprising a first press-in connection terminal, a second press-in connection terminal and a third press-in connection terminal, can be made by a process comprising the steps of splitting the first, second and third press-in connection terminals from one another by shear-cutting a plate member; bending the third press-in connection terminal in a first direction along an intermediate line between the first and second terminals; forming press contacting surfaces on corner portions of the first, second and third press-in terminals by swaging; and bending the third press-in terminals in a second opposite direction along the intermediate line between the first and second press-in terminals so that the press contacting surfaces are placed in an opposing relation. The terminals are thus arranged such that a conductor having a conductor cover can be pressed-in between the terminals of the contact, whereby pointed ends of terminals pierce the cover and the terminals create a pressure contact about the conductor.

8 Claims, 8 Drawing Sheets

1

1

4
5
6

4
5
6

4
4a
5a
5
6

4
4a
5a
5
6

1

1

4
5
6
14

4
5
6
14

4
5
6
5a
4a
14

4
5
6
5a
4a
14

4
5
6
13a
13b
14
14
14

PROCESS FOR MAKING PRESS-IN CONNECTION TYPE CONTACT

BACKGROUND OF THE INVENTION

1. Field of the Invention

This invention relates to a press-in connection type contact, in which a physical and electric connection (press-in connection) between a contact and a conductor is achieved by causing the contact to pierce through a coating of and engaging the conductor.

2. Brief Description of the Prior Art

U.S. Pat. No. 4,270,831 discloses a press-in connection type contact comprising a first press-in connection terminal, a second press-in connection terminal and a third press-in connection terminal, each extending upwardly. The first terminal and the second terminal are located side by side in an extending direction of a conductor, and the third terminal is located on an intermediate line between the first and second terminals but displaced radially of the conductor. Press contacting surfaces are formed respectively on opposing corners between the first and third press-in connection terminals and between the second and third press-in connection terminals and extending vertically. The conductor is able to be inserted, under pressure, into a space between the opposing press contacting surfaces of the first and third press-in connection terminals and a space between the opposing press contacting surfaces of the second and third press-in connection terminals for establishing a physical and electric connection between the contact and the conductor.

This contact has the advantages that the width in the implanting pitch direction of the contacts to be implanted in a row in a connector body can be reduced. In other words, the contact width in the parallel pitch direction of a multiconductor cable can be reduced, thus making it possible to adequately cope with the multiconductor cable having a very small pitch arrangement. In addition, the contact area with the conductor can be increased and a possible cutting of the conductor can be effectively prevented, thus ensuring a highly reliable electric connection.

However, while this conventional press-in connection type contact has the advantages as outlined above, it has the following disadvantages. Since it is essential that after a plate member is shear-cut to form three terminals, the inner corner portion of the third press-in connection terminal located at the center is swaged from the inner side and thereafter the inner corner portions of the opposite first and second press-in connection terminals are swaged respectively from the inner side, to thereby form the above-mentioned respective press contacting surfaces. This procedure takes much time and labor, which results in high cost. Moreover, since adjacent pairs of the shear-cut surfaces of the three press-in connection terminals are generally co-planar, it is difficult to perform the swaging operation smoothly and with high precision, with respect to the inner corner portions facing this plane when the slant swaging operation is to be performed from the inner side, because of dead corners of the respective swaging tools. Furthermore, harmful burrs are liable to be formed on the protruding side during the swaging operation. In addition, this procedure for cutting (cornering) each short contact pin to form the press contacting surfaces is not only unsuitable for a mass production line but also impractical because the procedure is slow and thus the cost is increased.

SUMMARY OF THE INVENTION

The present invention has been accomplished in order to obviate the above disadvantages inherent in the prior art.

It is therefore an object of the present invention to provide a process for making a press-in connection type contact, in which beautiful press contacting surfaces can be formed, with high precision and in a very simple manner, on respective inner corner portions of the three terminals.

Another object of the present invention is to provide a process for making a press-in connection type contact, which is capable of enhancing the practical use thereof by making the best use of the advantage of the press-in connection type contact of the above-mentioned three terminal structure.

To achieve the above objects, there is essentially provided a process for making a press-in connection type contact comprising a first end terminal, a second end terminal and a middle terminal, each extending in parallel, the first and second end terminal being located side by side in a plane, the third terminal being located in a position between the first and second terminals but displaced to one side of the plane. Press contacting surfaces are formed respectively on opposing corners between the first end terminal and the middle terminal and between the second end terminal and the middle terminal and extending in the longitudinal direction of the terminals. A conductor having a cover can be inserted, under pressure, into a space between the opposing press contacting surfaces of the first end terminal and the middle terminal and a space between the opposing press contacting surfaces of the second and terminal and the middle terminal for establishing a physical and electric connection between the contact and the conductor. The process for making the press-in connection type contact comprising the steps of shear-cutting a plate member to from three connection terminal including the first and second end terminals and the middle terminal; extruding the third press-in connection bending the middle terminal in a first direction such that it is spaced from and located on a first side of the plane which includes first and second end terminals; swaging corner portions of the first and second end terminals and the middle terminal to form press contacting surfaces thereon; and bending the middle terminal in a second direction opposite the first direction intermediate line between the first and second press-in such that the middle terminal is spaced from the first and second end terminals and is located on a second side of the plane opposite the first side thereof.

The process of the present invention may further comprise the steps of increasing a distance between the first and second terminals after the first bending step and before the swaging step; and decreasing the distance between the first and second terminals after the second bending step.

DETAILED DESCRIPTION OF THE EMBODIMENT

Figure 1:
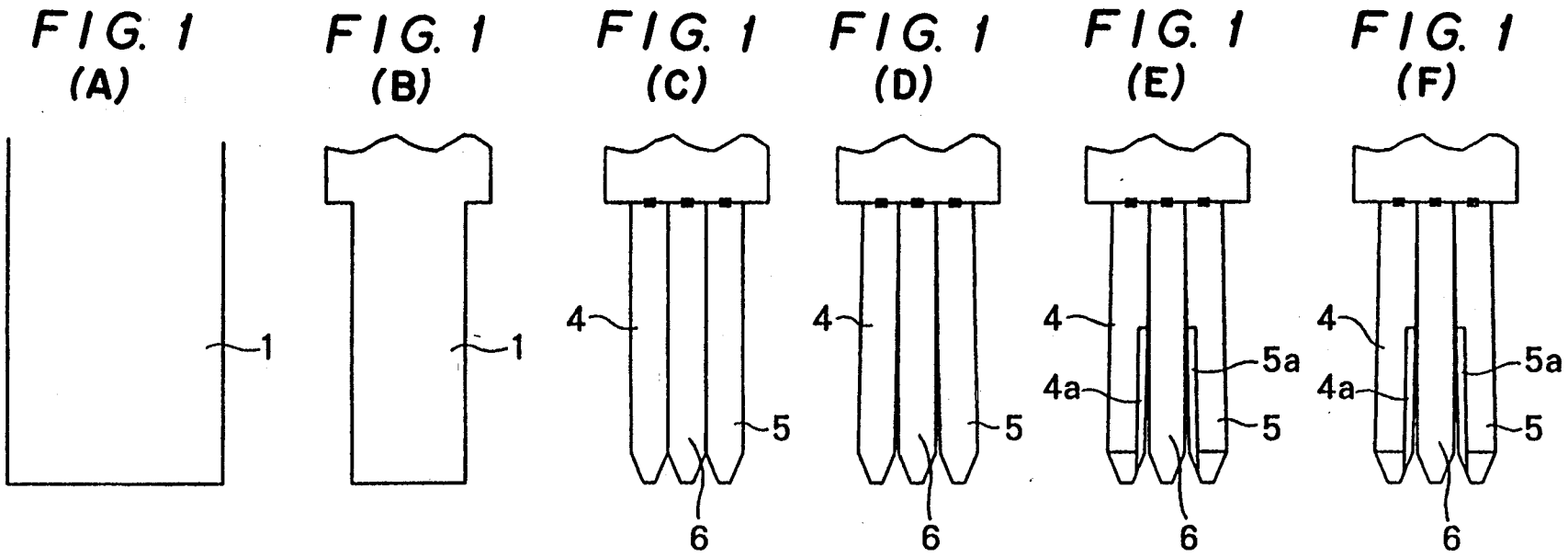
FIGS. 1(A) through 1(F) are side views, showing a plate member and a contact, for explaining the steps of a process for making a press-in connection type contact according to a first embodiment of the present invention.
Figures 2, 3:
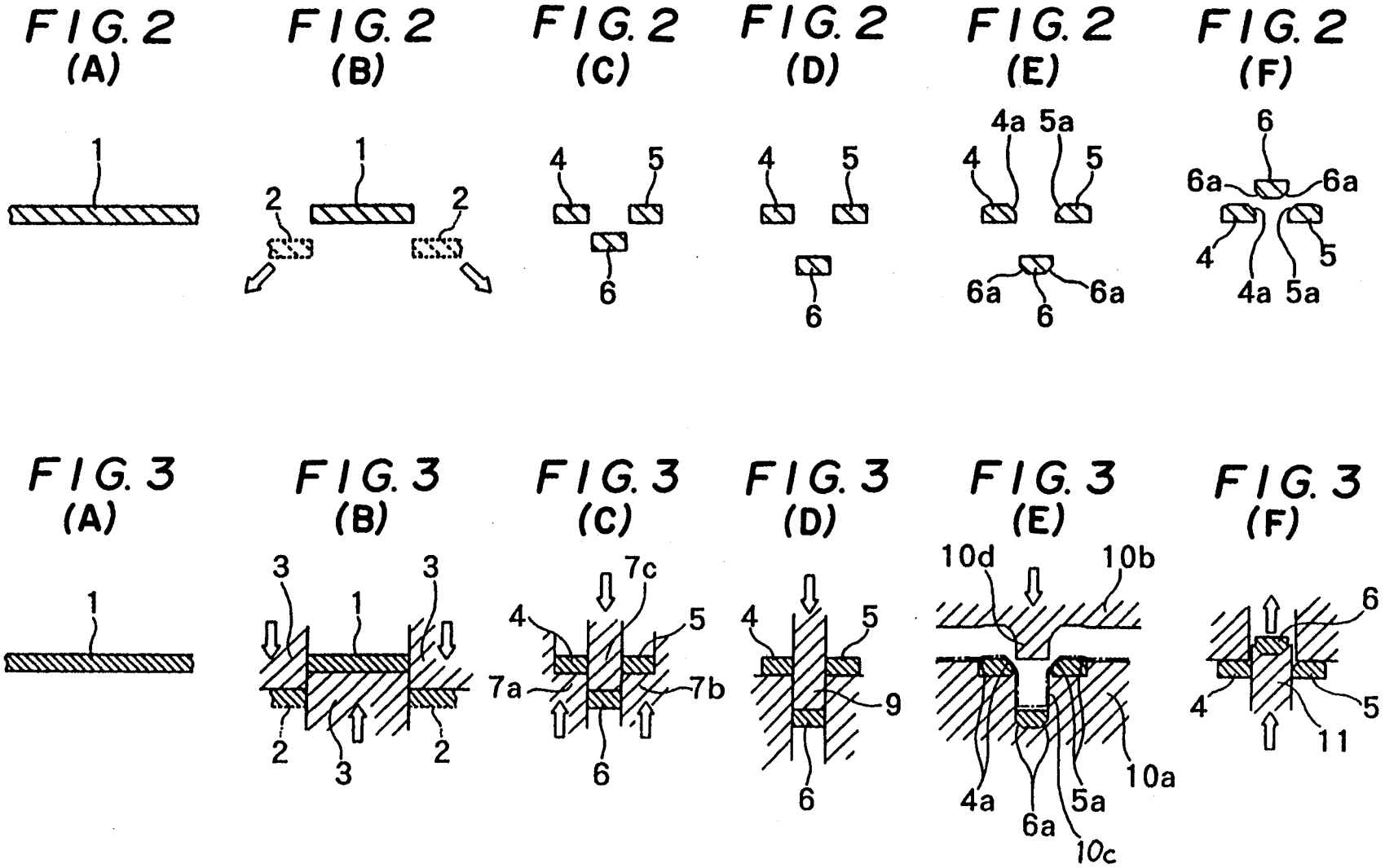
FIGS. 2(A) through 2(F) are cross-sectional views, of a plate member and a contact, for explaining the steps for of a process for making a press-in connection type contact according to the first embodiment of the present invention.
FIGS. 3(A) through 3(F) are cross-sectional views, of a molding tool, a plate member and a contact for explaining the steps of a process for making a press-in connection type contact according to the first embodiment of the present invention.

FIGS. 1, 2 and 3 illustrate a first embodiment of the present invention, and(A) through (F) of these FIGS. 1, 2 and 3 respectively illustrate the corresponding steps of a process for making a press-in connection type contact according to the first embodiment. As shown in (A) and (B) of FIGS. 1, 2 and 3, an unnecessary portion 2 of the plate member 1 is sheared off so that the plate member 1 may have paper a width dimension. In (B) of FIG. 3, the reference numeral denotes a shear cutter for shearing off the unnecessary portion 2.

As shown in (C) of FIGS. 1, 2 and 3, the plate member 1 is subjected to a punching-out operation using shear-cutters *7a, 7b* and *7c* so as to be separated or sheared into first, second and third press-in connection terminals (which are also referred to as the first and second end terminals and the middle terminal, respectively) 4, 5 and 6 which are connected together at their basal portions. In this operation, the intermediate third press-in connection terminal 6 is bent in a first direction radially of a conductor 8 which is to be pressed between the terminals (i.e. in a normal direction to a plane defined by the first and second terminals 4 and 5) but on an intermediate line between the opposite first and second press-in connection terminals 4 and 5.

The shear cutter for punching out the first, second and third press-in connection terminals 4, 5 and 6 is operated to shear the plate member 1 to form the first, second and third press-in connection terminals 4, 5 and 6 by knocking a central sliding cutter *7c* into a space between first and second stationary cutters *7a* and *7b*, and at the same time, to bend the third press-in connection terminal 6 toward one side on the intermediate line between the first and second press-in connection terminals 4 and 5.

Although not illustrated, the cutters *7a, 7b* and *7c* may be arranged such that the intermediate cutter (e.g. *7c*) is a stationary cutter, and the outer cutters (e.g. *7a* and *7b*) are sliding cutters, and operated so that the first and second press-in connection terminals 4 and 5 are bent to one side of a plane including the third press-in connection terminal 6. In any case, the third press-in connection terminal 6 is bent in the above-mentioned direction relative to the remaining first and second press-in connection terminals 4 and 5.

As shown in (D) of FIGS. 1, 2 and 3, the third press-in connection terminal 6 is further bent in the above-mentioned direction by a bending mold 9, so that the third press-in connection terminal 6 is separated sufficiently from the first and second press-in connection terminals 4 and 5. The required amount of bending of the third press-in connection terminal 6 may be carried out in the shear-cutting operation as shown in (C) of FIGS. 1, 2 and 3, so that the extruding process as shown in (D) of FIGS. 1, 2 and 3 can be omitted.

As shown in (E) of FIGS. 1, 2 and 3, press contacting surfaces *4a, 5a* and *6a* are formed from corner portions of the first, second and third press-in connection terminals 4, 5 and 6 by subjecting the terminals 4, 5 and 6 to swaging operation by using swaging molds *10a* and *10b*. The swaging mold *10a* is of a stationary type, while the other swaging mold *10b* is of a sliding type. The stationary swaging mold *10a* has a female mold portion *10c* for receiving therein the third press-in connection terminal 6. This female mold portion *10c* is provided at a bottom surface thereof with a slant mold portion for forming the press contacting surfaces *6a* from the outer corner portions of the third press-in connection terminal 6. A male mold portion *10d* of the sliding swaging mold *10b* is knocked into the female mold portion *10c* to forcibly press the third press-in connection terminal 6 against the bottom surface of the female mold portion *10c* so that the press contacting surfaces *6a* are formed. At the same time, the second and third press-in connection terminals 5 and 6 are fitted to and supported by opposite shoulder portions at an inlet portion of the female mold portion *10c* of the stationary swaging mold *10a*, and the outer corner portions of the first and second press-in connection terminals 4 and 5 are swaged by the slant swaging portions which are formed on opposite sides of a basal portion of the male mold portion *10d* of the sliding swaging mold *10b* to form the press contacting surfaces *4a* and *5a*. Thus, the corner portions *6a* of the middle terminal 6 are facing a first direction in which the middle terminal 6 is first bent, and the corner portions *4a* and *5a* are facing a second direction, opposite the first direction, in which the middle terminal 6 is bent the second time.

As shown in (F) of FIGS. 1, 2 and 3, the third press-in connection terminal 6 is bent toward the opposite side (i.e. from one side to the other) of the first and second press-in connection terminals 4 and 5 using the extruding mold 11, to thereby provide the objective press-in connection type contact.

As shown in FIGS. 7 through 10, in the press-in connection type contact thus constructed, the first, second and third press-in connection terminals 4, 5 and 6 are located side by side and extend upwardly from a connecting portion 12, the first and second press-in connection terminals 4 and 5 are separated from each other along an axial direction of the conductor 8 which is to be pressed between the terminals (i.e. along a transverse direction of the terminals themselves), therein, and the third press-in connection terminal 6 is located on an intermediate line between the first and second press-in connection terminals 4 and 5 but displaced radially of the conductor 8 (i.e. displaced in a direction normal to a plane defined by the first and second terminals 4 and 5). The press-in connection type contact further has slanted press contacting surfaces 4*a* and 6*a* formed respectively on mutually opposing corners of the first and third press-in connection terminals 4 and 6 and extending in a vertical direction (i.e. in an axial direction of the terminals), and slanted press contacting surfaces 5*a* and 6*a* formed respectively on opposing mutually corners between the second and third press-in connection terminals 5 and 6 and extending in the vertical direction (see FIG. 10).

Figure 10:
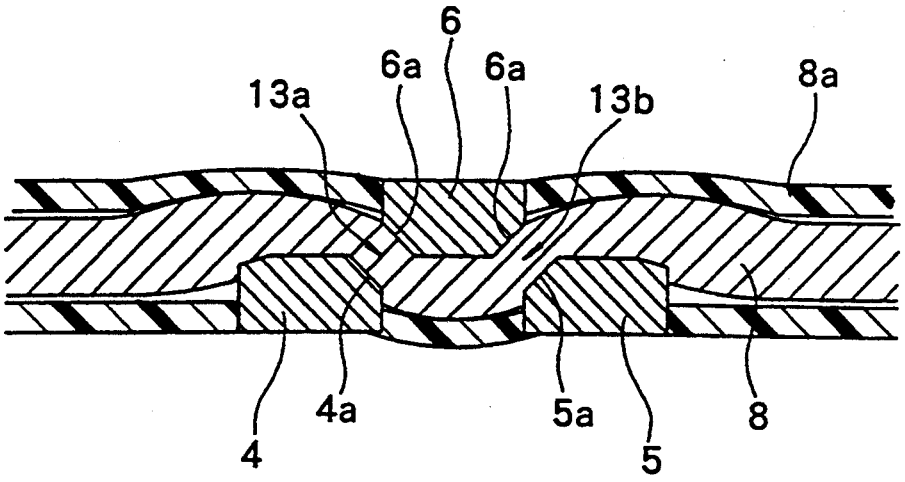
FIG. 10 is a sectional view showing the state in which the press-in connection type contact is in press-in connection with a conductor.

A first press-in space 13*a* is formed between the press contacting surfaces 4*a* and 6*a*, while a second press-in space 13*b* is formed between the press contacting surfaces 5*a* and 6*a*. As shown in FIG. 10, the conductor is inserted, under pressure, into the first and second press-in spaces 13*a* and 13*b* is press-held between the press contacting surfaces 4*a* and 6*a* and between the press contacting surfaces 5*a* and 6*a*, for establishing a physical and electric connection between the contact and the conductor.

More specifically, the first, second and third press-in connection terminals 4, 5 and 6 are provided with pointed ends 14, respectively, which are formed by the shear-cutting and swaging, or are formed thereafter. The conductor 8 is inserted into the first and second press-in spaces 13*a* and 13*b* while allowing the coating 8*a* of the conductor 8 to be pierced through by these pointed ends 14, thereby establishing the physical and electric connection.

Figure 4:
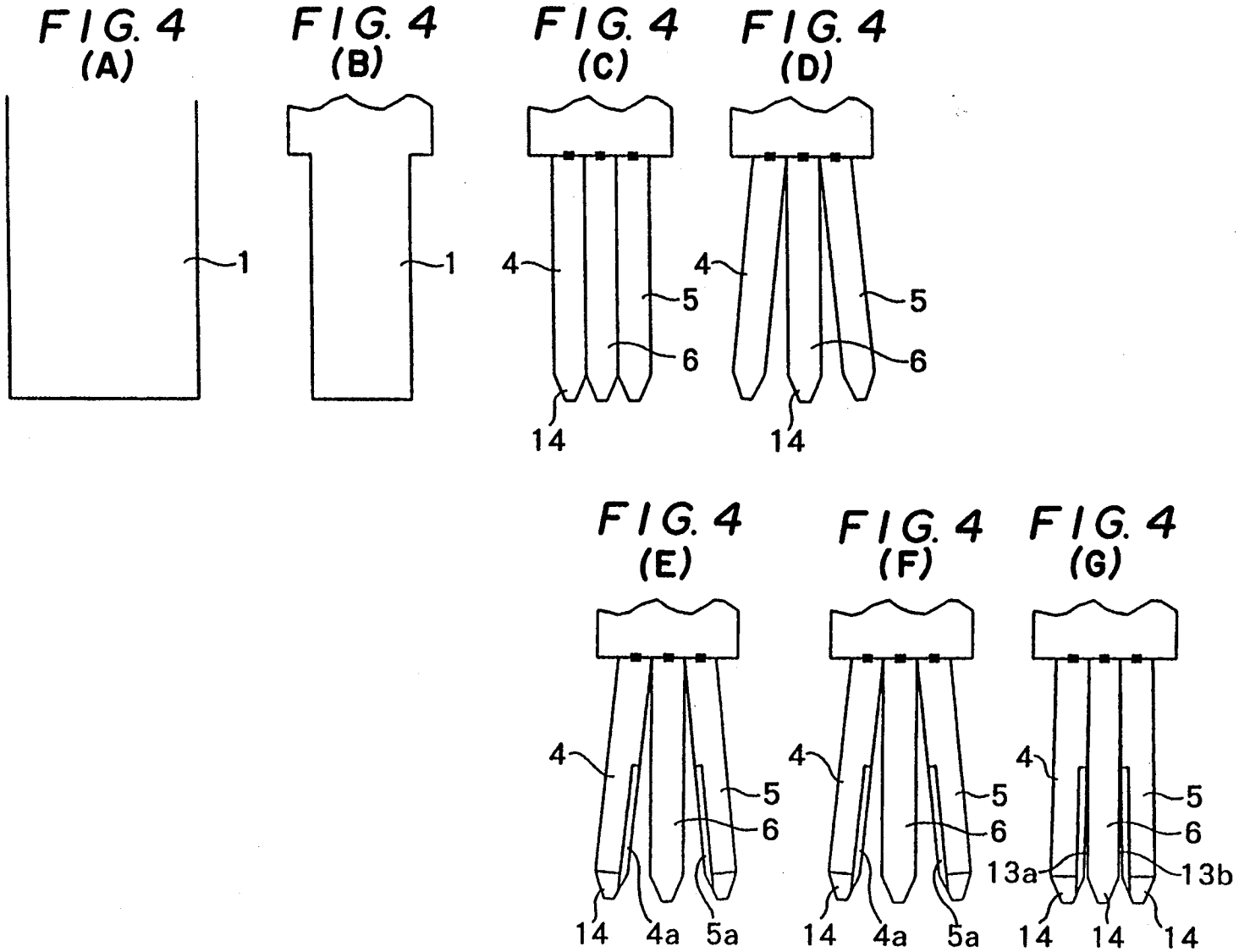
FIGS. 4(A) through 4(G) are side views, of a plate member and a contact, for explaining the steps of a process for making a press-in connection type contact according to a second embodiment of the present invention.
Figure 5:
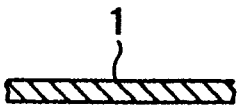
FIGS. 5(A) through 5(G) are cross-sectional views, of a plate member and a contact, for explaining the steps of out a process for making a press-in connection type contact according the second embodiment of the present invention.
Figure 5:
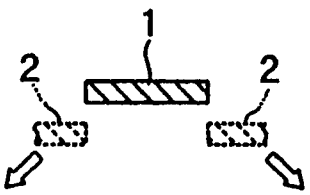
Figure 5:
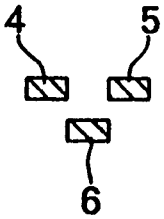
Figure 5:
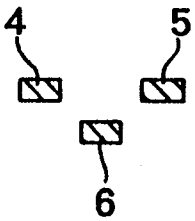
Figure 5:
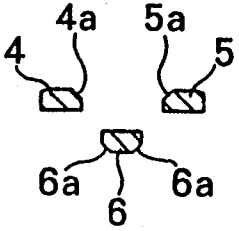
Figure 5:
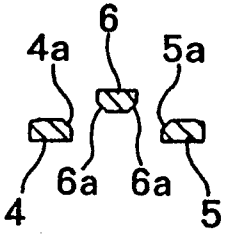
Figure 5:
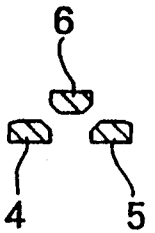
Figure 6:
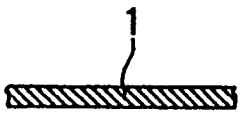
FIGS. 6(A) through 6(G) are cross-sectional views, of a molding tool, a plate member and a contact for explaining the steps of a process for making a press-in connection type contact according to the second embodiment of the present invention.
Figure 6:
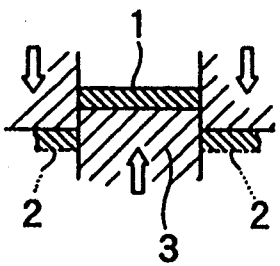
Figure 6:
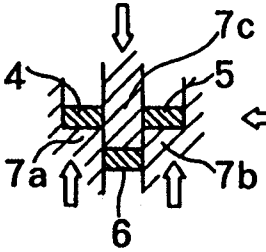
Figure 6:
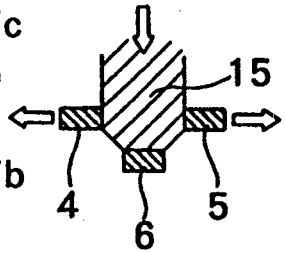
Figure 6:
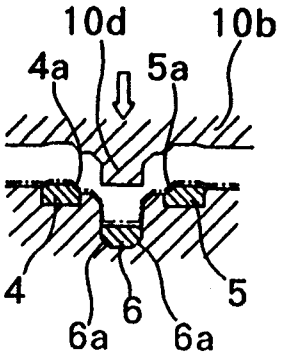
Figure 6:
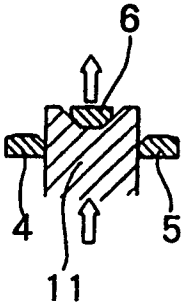
Figure 6:
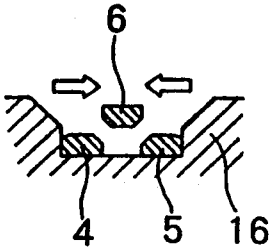
Figure 7:
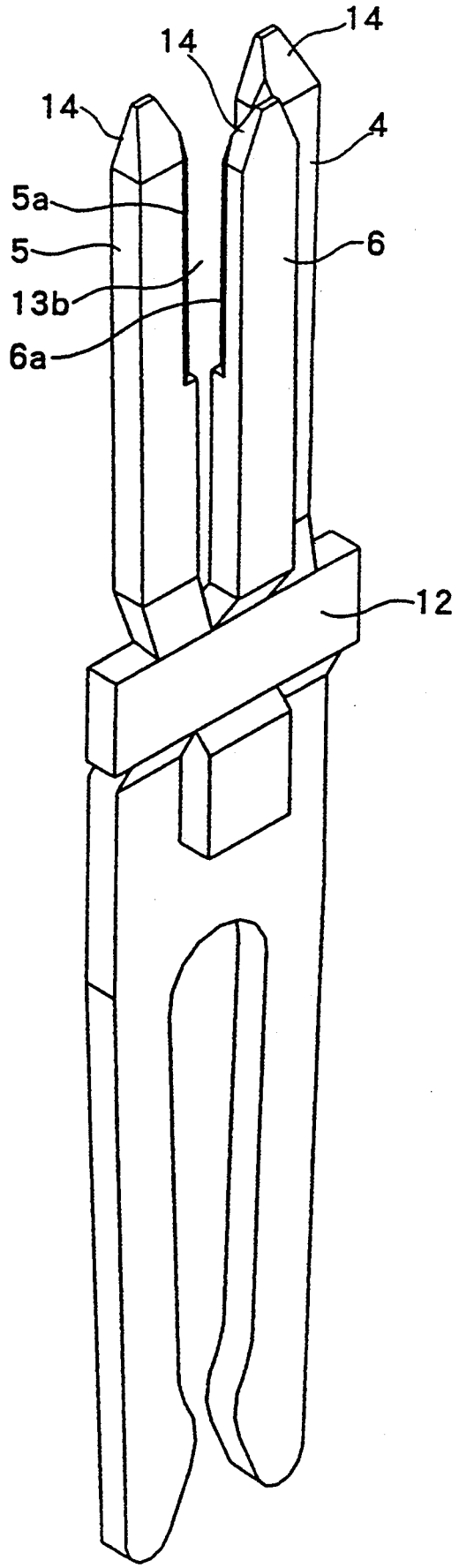
FIG. 7 is a perspective view of a press-in connection type contact which can be obtained in accordance with the first and second embodiments.
Figure 8:
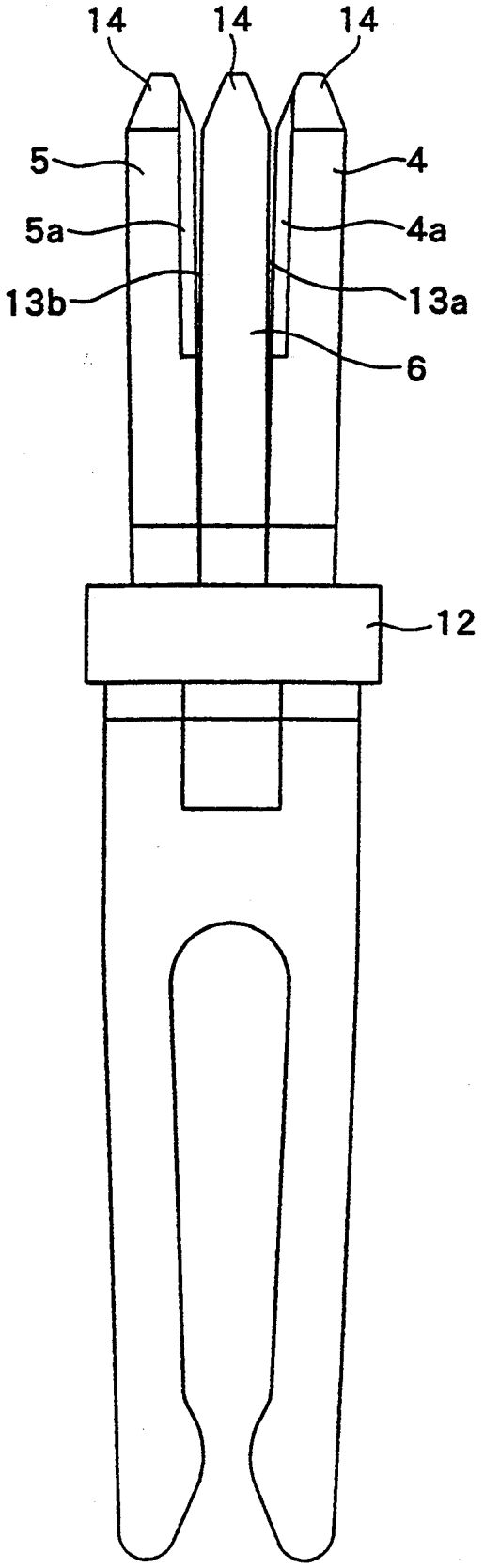
FIG. 8 is a side view of FIG. 7.
Figure 9:
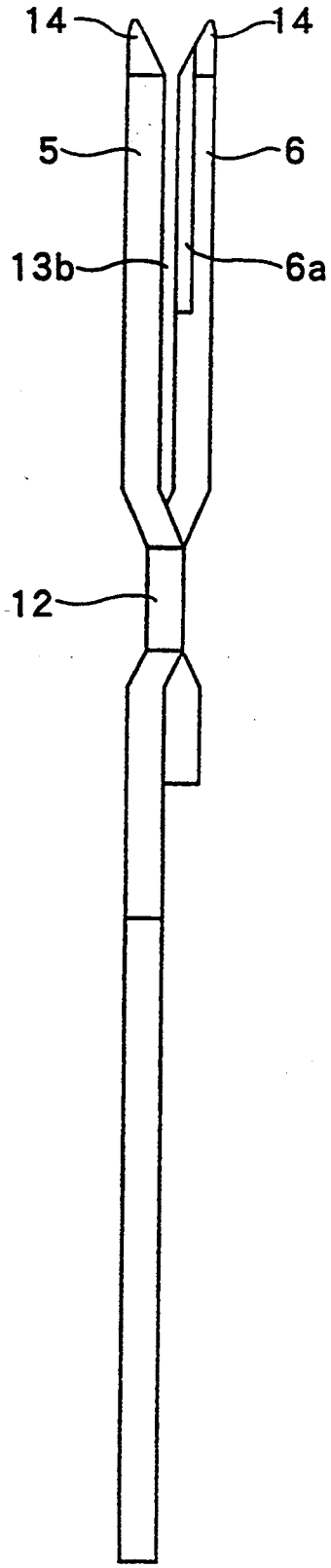
FIG. 9 is a front view of FIG. 7.

FIGS. 4, 5 and 6 illustrate a second embodiment of the present invention. (A) through (F) of FIGS. 4, 5 and 6 show process steps corresponding to each other. In this embodiment, process steps shown in (D) and (G) are added to those of the first embodiment, and the remaining process steps of this second embodiment are substantially the same as in the first embodiment.

Specifically, according to this second embodiment, after the first, second and third press-in connection terminals 4, 5 and 6 are formed by shearing, the distance between the first and second press-in connection terminals 4 and 5 are sufficiently increased by using a dilating mold 15 as shown in (D) of the respective Figures, and then the terminals 4, 5 and 6 are subjected to swaging as shown in (E) of the respective Figures. By making the distance between the first and second press-in connection terminals 4 and 5 longer than the final distance, the swaging operation can be performed smoothly, the swaging mold 10*b* can be more freely designed, and the precision of the press contacting surfaces 4*a* and 5*a* formed by swaging can be improved.

As shown in (E) of the respective Figures, after the third press-in connection terminal 6 is bent into a normal position, the distance of the first and second press-in connection terminals 4 and 5 are decreased using a reducing mold 16, so that the separation distance is reduced to the normal distance, as shown in (G) of the respective Figures.

As shown in FIGS. 7 through 10, there can be obtained a press-in connection type contact having the first, second and third press-in connection terminals 4, 5 and 6 and press contacting surfaces 4*a*, 5*a* and 6*a* at opposite corner portions of the respective terminals as in the first embodiment.

According to the present invention, there can be provided the effective press contacting surfaces for the press-in connection type contact having a three terminal structure as shown in the above-mentioned U.S. Pat. No. 4,270,831, and there can be made best use of the advantages of this contact.

That is, in the process for swaging the outer corner portions of the first, second and third press-in connection terminals obliquely from the outer side in the state where the third press-in connection terminal is bent toward one side, the swaging operation can be smoothly performed without being disturbed by the remaining press-in connection terminals, thus enabling the formation of beautiful press contacting surfaces with high precision.

It should be understood that the present invention is not limited to the above embodiments, and various changes and modifications can be made within the spirit of the invention.

What is claimed is:

1. A process for making a press-in connection type contact, comprising:

shear-cutting a plate member to form three connection terminals including a first end terminal, a second end terminal and a middle terminal;

bending said middle terminal in a first direction such that it is spaced from and located on a first side of a plane which includes said first and second end terminals;

swaging corner portions of said first and second end terminals and said middle terminal to form press contacting surfaces thereon; and bending said middle terminal in a second direction opposite said first direction such that said middle terminal is spaced from said first and second end terminals and is located on a second side of the plane opposite said first side thereof.

2. A process as recited in claim 1, further comprising prior to swaging the corner portions of said first and second end terminals and said middle terminal and after bending said middle terminal in said first direction, increasing a distance between said first and second end terminals; and after bending said middle terminal in said second direction, decreasing the distance between said first and second end terminals.

3. A process as recited in claim 2, wherein in swaging the corner portions of said first and second end terminals and said middle terminal, the corner portions of said first and second end terminals which are subjected to swaging are corner portions facing in said second direction, and the corner portions of said middle terminal which are subjected to swaging are corner portions facing in said first direction;

whereby, after bending of said middle terminal in said second direction, a press contacting surface of said first end terminal and a press contacting surface of said middle terminal are disposed opposite one another, and a press contacting surface of said second end terminal and another press contacting surface of said middle terminal are disposed opposite one another.

4. A process as recited in claim 1, wherein in swaging the corner portions of said first and second end terminals and said middle terminal, the corner portions of said first and second end terminals which are subjected to swaging are corner portions facing in said second direction, and the corner portions of said middle terminal which are subjected to swaging are corner portions facing in said first direction;

whereby, after bending of said middle terminal in said second direction, a press contacting surface of said first end terminal and a press contacting surface of said middle terminal are disposed opposite one another, and a press contacting surface of said second end terminal and another press contacting surface of said middle terminal are disposed opposite one another.

5. A process for making a press-in connection type contact comprising first and second end terminals and a middle terminal, the first and second end terminals being disposed in a plane and being spaced apart from one another, and the middle terminal being disposed to one side of the plane, the first and second end terminals and the middle terminal being arranged to receive therebetween a conductor having a conductor cover such that a physical and electrical connection is established between the contact and the conductor, said process comprising:

shear-cutting a plate member to form three connection terminals including the first end terminal, the second end terminal and the middle terminal;

bending said middle terminal in a first direction such that it is spaced from and located on a first side of the plane which includes said first and second end terminals;

swaging corner portions of said first and second end terminals and said middle terminal to respectively form press contacting surfaces thereon; and bending said middle terminal in a second direction opposite said first direction such that said middle terminal is spaced from said first and second end terminals and is located on a second side of the plane opposite said first side thereof.

6. A process as recited in claim 5, further comprising prior to swaging the corner portions of said first and second end terminals and said middle terminal and after bending said middle terminal in said first direction, increasing a distance between said first and second end terminals; and after bending said middle terminal in said second direction, decreasing the distance between said first and second end terminals.

7. A process as recited in claim 6, wherein in swaging the corner portions of said first and second end terminals and said middle terminal, the corner portions of said first and second end terminals which are subjected to swaging are corner portions facing in said second direction, and the corner portions of said middle terminal which are subjected to swaging are corner portions facing in said first direction;

whereby, after bending of said middle terminal in said second direction, a press contacting surface of said first end terminal and a press contacting surface of said middle terminal are disposed opposite one another, and a press contacting surface of said second end terminal and another press contacting surface of said middle terminal are disposed opposite one another.

8. A process as recited in claim 5, wherein in swaging the corner portions of said first and second end terminals and said middle terminal, the corner portions of said first and second end terminals which are subjected to swaging are corner portions facing in said second direction, and the corner portions of said middle terminal which are subjected to swaging are corner portions facing in said first direction;

whereby, after bending of said middle terminal in said second direction, a press contacting surface of said first end terminal and a press contacting surface of said middle terminal are disposed opposite one another, and a press contacting surface of said second end terminal and another press contacting surface of said middle terminal are disposed opposite one another.

* * * * *